US007044843B1

(12) United States Patent
Lin

(10) Patent No.: US 7,044,843 B1
(45) Date of Patent: May 16, 2006

(54) SANDER DEVICE HAVING VACUUMING STRUCTURE

(76) Inventor: Kun Yi Lin, No. 261, Sec. 1, Liaonin Road, Beitun, Taichung 40675 (TW)

( * ) Notice: Subject to any disclaimer, the term of this patent is extended or adjusted under 35 U.S.C. 154(b) by 0 days.

(21) Appl. No.: 11/124,883

(22) Filed: May 9, 2005

(51) Int. Cl.
*B24B 7/00* (2006.01)

(52) U.S. Cl. ..... 451/178; 451/231; 451/456; 451/361

(58) Field of Classification Search ..... 451/178, 451/456, 360, 361, 231, 541
See application file for complete search history.

(56) References Cited

U.S. PATENT DOCUMENTS 2,667,017 A * 1/1954 Jaron ..... 451/456
2,763,972 A * 9/1956 White ..... 451/456
3,098,332 A * 7/1963 Sutton ..... 451/453
4,088,164 A * 5/1978 McCord, Jr. ..... 144/252.1
4,296,572 A * 10/1981 Quintana ..... 451/356
4,805,353 A * 2/1989 Keith et al. ..... 451/456
5,231,801 A * 8/1993 Svetlik et al. ..... 451/456
5,860,852 A * 1/1999 Hashii et al. ..... 451/157
6,095,906 A 8/2000 Wang ..... 451/65
6,139,411 A * 10/2000 Everts et al. ..... 451/359
6,470,778 B1 * 10/2002 Kaye et al. ..... 83/100
6,533,649 B1 3/2003 Wang ..... 451/310
6,699,108 B1 * 3/2004 Chiang ..... 451/87

* cited by examiner

*Primary Examiner*—Eileen P. Morgan
(74) *Attorney, Agent, or Firm*—Charles E. Baxley

(57) ABSTRACT

A sander device includes a platform having an orifice, a chamber and one or more apertures formed in an outer surface and communicating with the chamber. A rotatable sander member is extended through the orifice of the platform, for being driven to abrade or polish or sand objects, and to generate sand dusts. The aperture of the platform is arranged to allow the sand dusts to be drawn or vacuumed into the chamber via the aperture of the platform. A base has a bracket for rotatably supporting the sander member. A plate may be secured to the platform and has an opening aligned with the orifice of the platform, for receiving the sander member.

10 Claims, 5 Drawing Sheets

SANDER DEVICE HAVING VACUUMING STRUCTURE

BACKGROUND OF THE INVENTION

1. Field of the Invention

The present invention relates to an abrading machine, a polishing machine, a sander machine or a sander device, and more particularly to a sander device having a vacuuming structure for vacuuming or drawing or collecting the sand dust that may be generated by the abrading machine, polishing machine, sander machine or sander device.

2. Description of the Prior Art

Typical abrading machines, polishing machines, sander machines or sander devices comprise one or more motors, one or more sander barrels or wheels or belts or members rotatably attached to a table and coupled to the motors, for being rotated or driven to sand or polish objects.

For example, U.S. Pat. No. 6,095,906 to Wang, and U.S. Pat. No. 6,533,649 to Wang disclose two of the typical abrading machines or polishing machines or sander machines each comprising one or more sander barrels or wheels or belts or members rotatably attached to and coupled to one or more motors, for being rotated or driven by the motors.

Normally, the typical abrading machines or polishing machines or sander machines each comprises one or more working tables or platforms disposed beneath or close to the sander barrels or wheels or belts or members, for supporting the objects to be sanded or polished.

However, while working or when grinding or sanding or polishing the objects, sand dusts may be generated and may fly everywhere. However, the typical abrading machines or polishing machines or sander machines fail to provide any vacuuming devices or machines to vacuum or to draw and to collect the sand dusts, such that the sand dusts may fly everywhere within the working environment and may seriously pollute the lungs of the users or workers.

The present invention has arisen to mitigate and/or obviate the afore-described disadvantages of the conventional abrading machines or polishing machines or sander machines.

SUMMARY OF THE INVENTION

The primary objective of the present invention is to provide an abrading machine, a polishing machine, or a sander machine or a sander device including a vacuuming structure for vacuuming or drawing or collecting the sand dust that may be generated by the abrading machine, polishing machine, sander machine or sander device.

The other objective of the present invention is to provide a sander device including an adjustable structure for adjustably supporting two or more sander barrels of different sizes or outer diameters.

The further objective of the present invention is to provide a sander device including two or more throat or supporting plates having openings of different sizes or inner diameters for adjustably supporting sander barrels of different sizes or outer diameters.

In accordance with one aspect of the invention, there is provided a sander device comprising a platform including an orifice formed therein, and including a chamber formed therein, and including at least one aperture formed in an outer surface thereof and communicating with the chamber thereof, and a rotatable sander member extend through the orifice of the platform, for being driven to abrade or polish or sand objects, and to generate sand dusts. The aperture of the platform is arranged to allow the sand dusts to be drawn or vacuumed into the chamber via the aperture of the platform.

The platform includes an outlet port provided therein for coupling to a vacuum device. The platform includes a bottom plate attached thereto and having the outlet port provided therein.

A base may further be provided and a bracket may further be provided and attached to the base for rotatably supporting the sander member thereon. The bracket includes an axle rotatably disposed thereon, the sander member is secured to the axle. The platform includes a rod extended therefrom and adjustably secured to the bracket.

The platform includes a plate secured thereto and having an opening formed therein and aligned with the orifice of the platform, and arranged for receiving the sander member. The plate includes at least one hole formed therein and arranged for communicating with the chamber of the platform, for allowing the sand dust to also flow into the chamber of the platform via the hole of the plate.

The platform includes a peripheral shoulder formed therein, and located around the orifice thereof, for seating the plate therein. The platform includes at least one second plate selectively secured thereto and having an opening formed therein, and the opening of the second plate includes an area different from that of the opening of the plate. The platform includes a block selectively secured thereto and engaged into the orifice thereof, to partially fill the orifice thereof.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
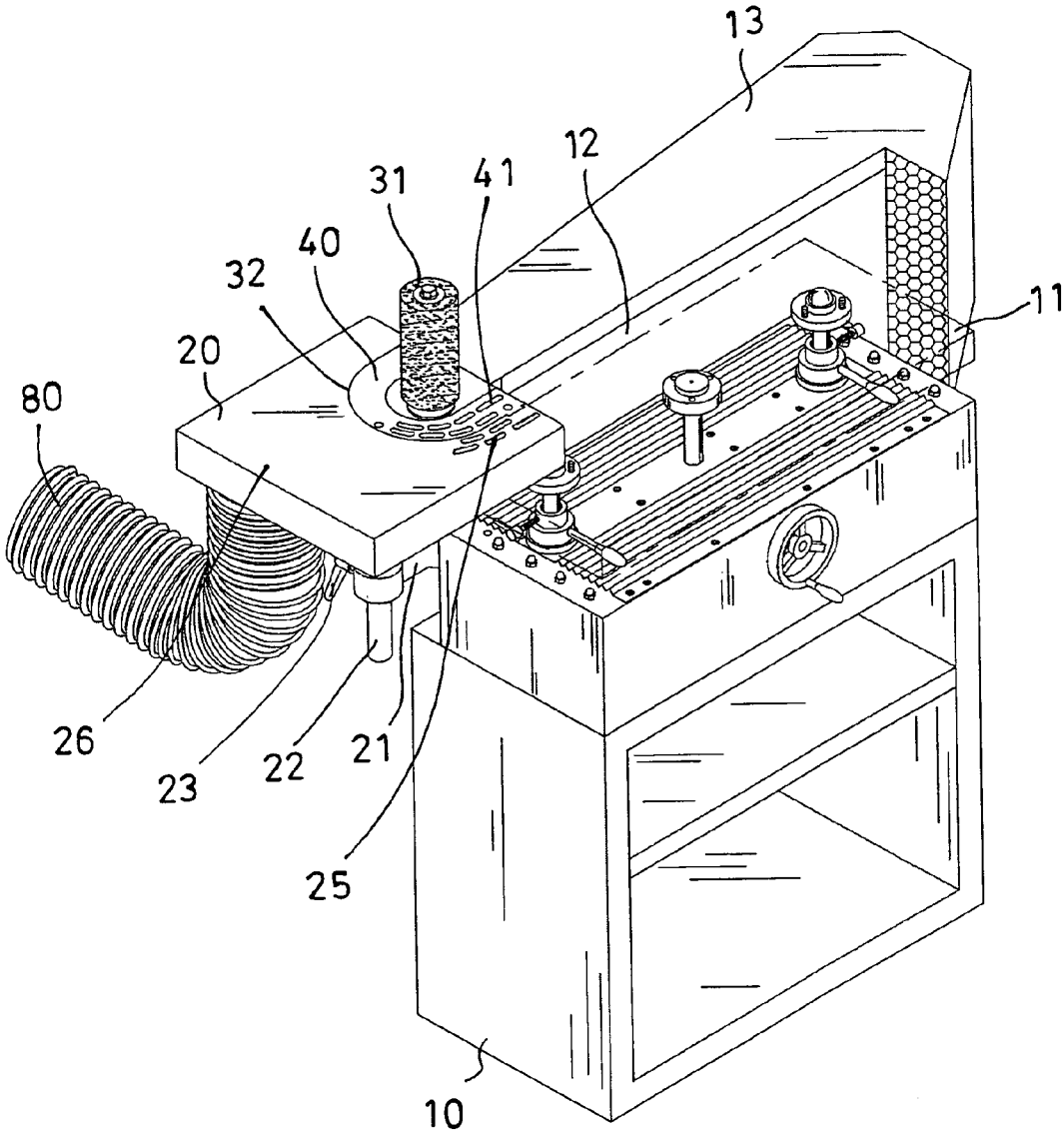
FIG. 1 is a partial perspective view of a sander device in accordance with the present invention.
Figure 2:
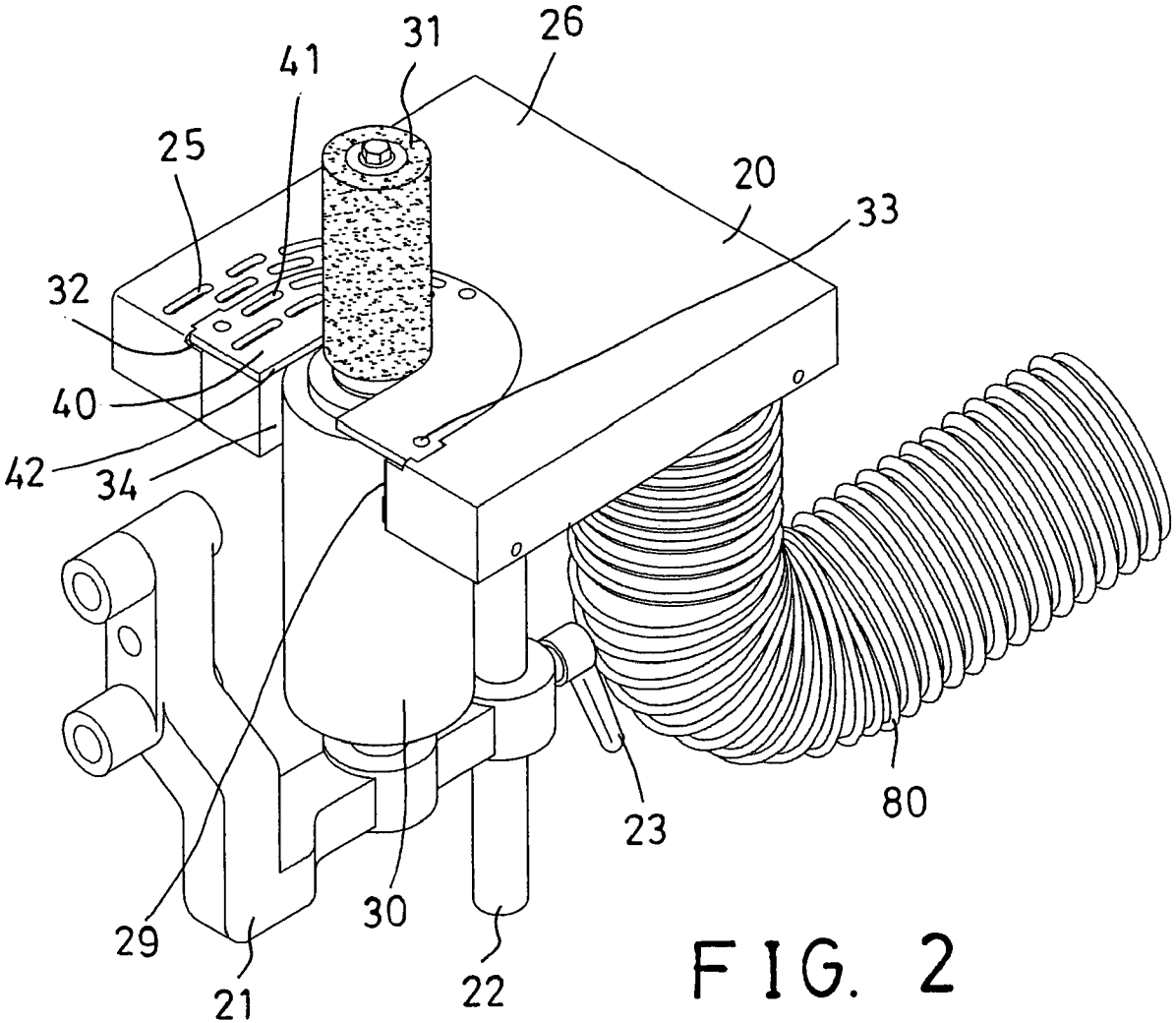
FIG. 2 is an enlarged partial perspective view of the sander device.
Figure 3:
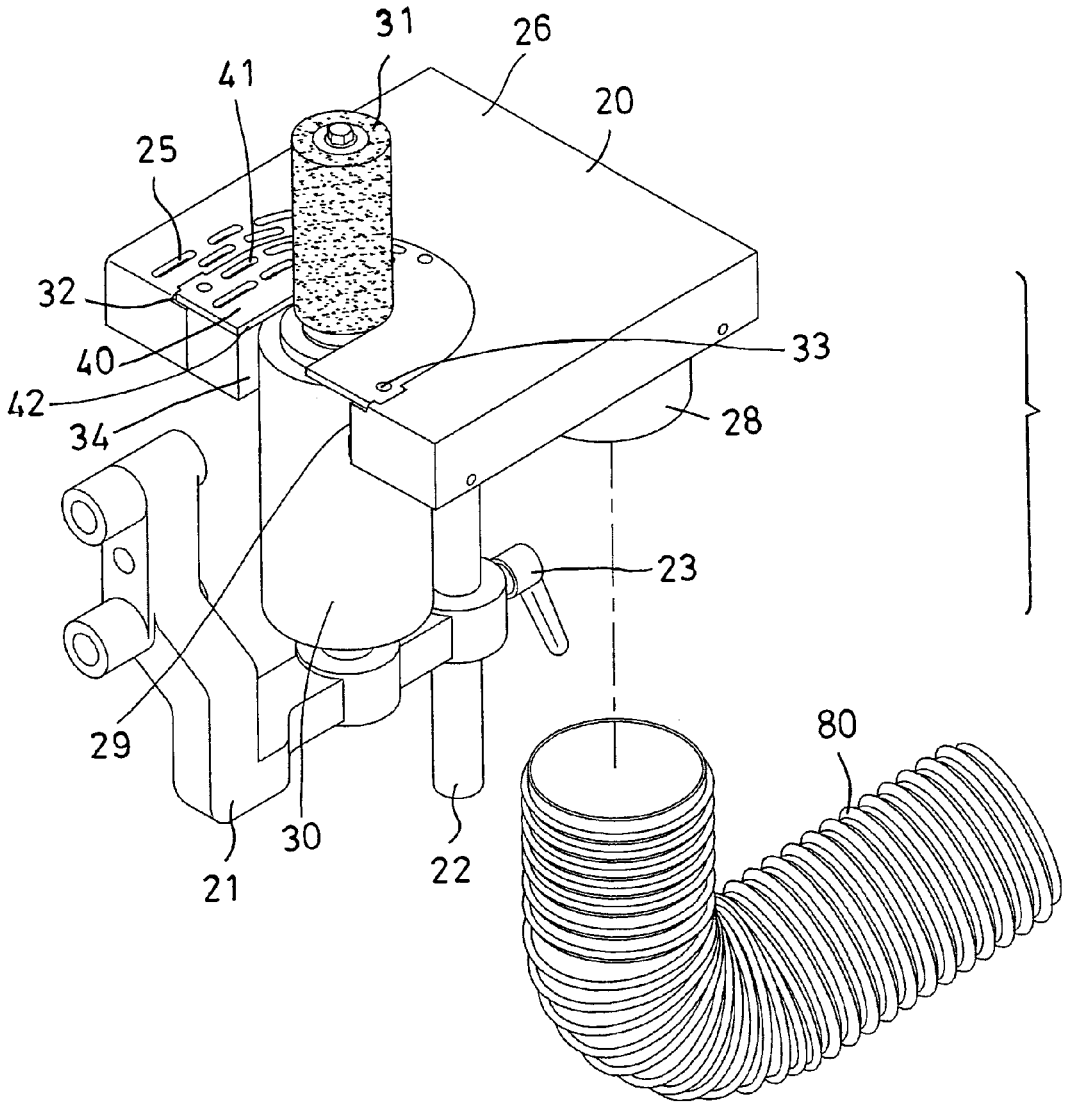
FIG. 3 is a partial exploded view of the sander device.

Referring to the drawings, and initially to FIGS. 1–3, an abrading machine, a polishing machine, or a sander machine or a sander device in accordance with the present invention comprises a base 10 including a typical working table 11 disposed or provided thereon, for rotatably supporting one or more sander wheels or belts or members 12 thereon which may be coupled to one or more motors, for being rotated or driven by the motors to sand or to polish various objects. A casing 13 may be attached to the working table 11, for partially shielding or covering the sander wheels or belts or members 12.

A platform 20 includes a bracket 21 attached thereto, such as attached to the sides or to the bottom thereof, for attaching or securing to the working table 11 or to the base 10 with such as fasteners, latches (not shown), or the like. For example, the platform 20 may include a rod 22 extended downwardly therefrom for adjustably attaching or securing to the bracket 21 with such as a fastener 23 or the like, and for allowing the platform 20 to be adjusted up and down relative to the bracket 21 or relative to the working table 11 or to the base 10.

Figure 4:
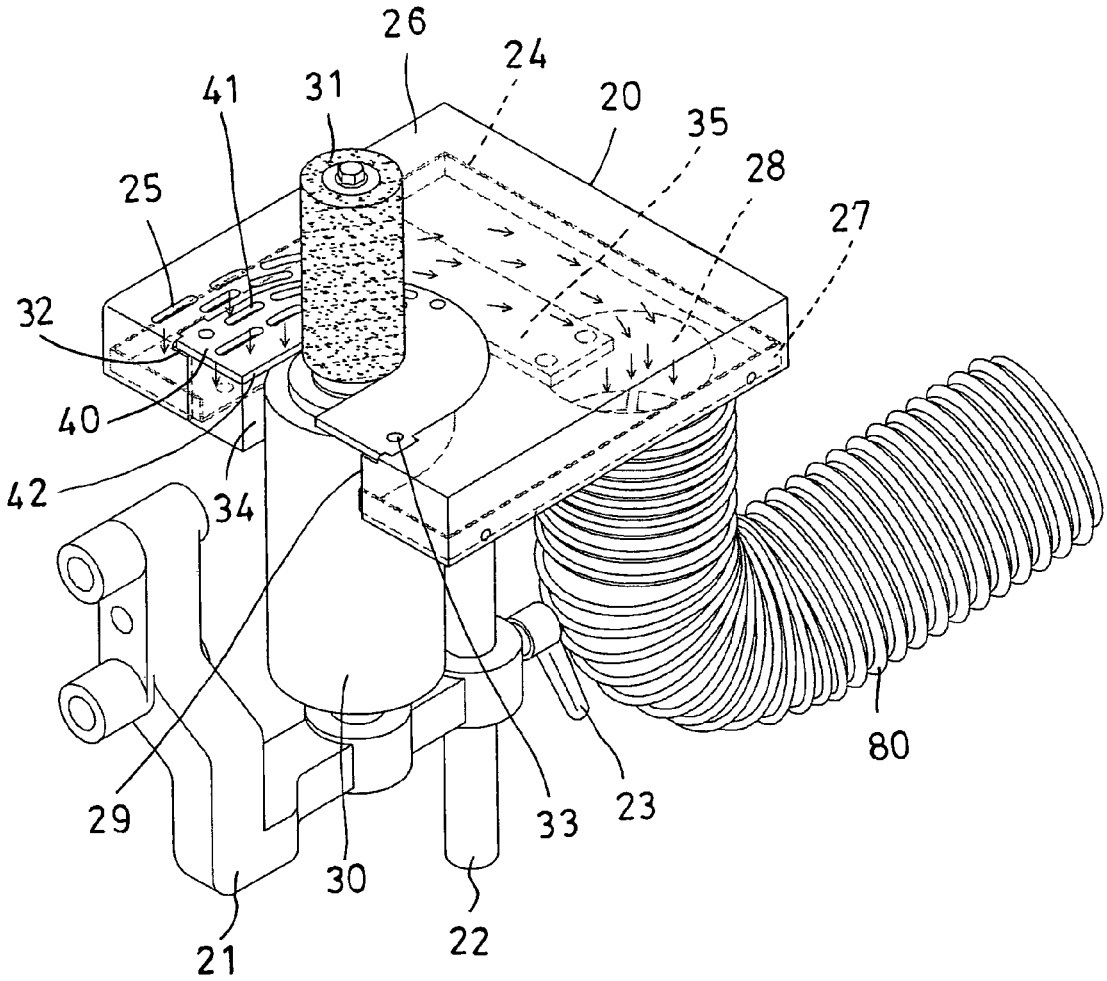
FIG. 4 is an enlarged partial perspective view similar to FIG. 2, illustrating the operation of the sander device.
Figure 5:
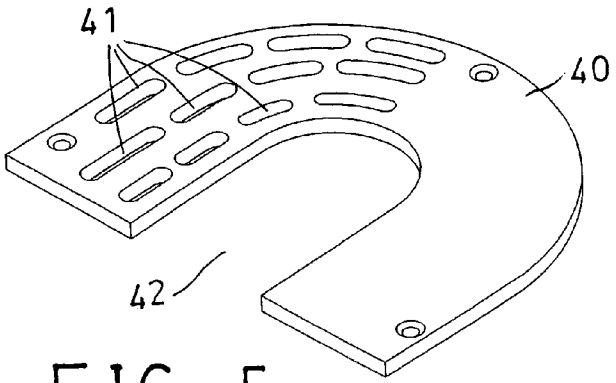
FIG. 5 is an enlarged perspective view illustrating a throat plate or supporting plate for the sander device.
Figure 6:
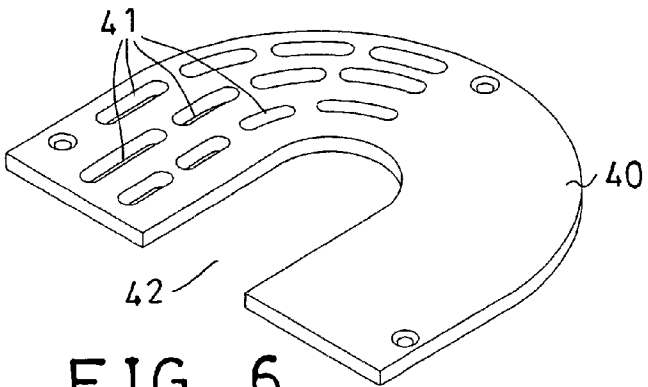
FIGS. 6, 7, 8 are enlarged perspective views similar to FIG. 5, illustrating the other embodiments of the throat plates or supporting plates for the sander device.
Figure 7:
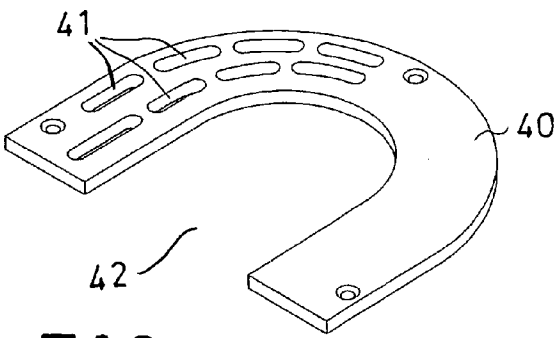
Figure 8:
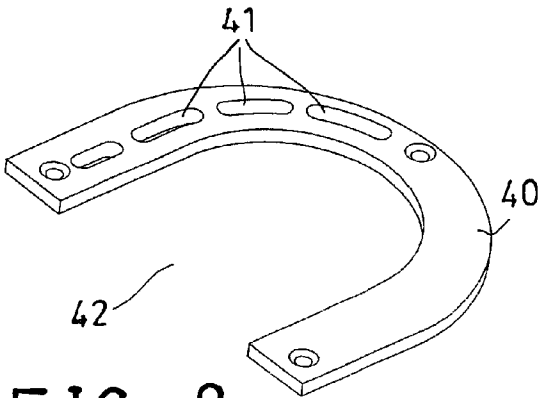

As shown in FIG. 4, the platform 20 includes a chamber 24 formed therein, and includes one or more apertures 25 formed in the upper or outer surface 26 thereof and communicating with the chamber 24 thereof, for allowing air or sand dust to flow into the chamber 24 via the apertures 25 of the platform 20. The platform 20 further includes a bottom or inner surface or plate 27 attached or secured thereto and having an outlet port 28 formed or provided therein (FIG. 3), for coupling to a vacuum device (not shown) via a hose 80 or the like.

A motor or a motor-driven axle 30 is disposed or attached onto the bracket 21, for indirectly attached onto the working table 11 or the base 10, or the axle 30 may also be directly attached onto the working table 11 or the base 10. The axle 30 may include a sander wheel or sander barrel or sander member 31 disposed thereon, and rotated in concert with the axle 30 that may be rotated or driven by a motor (not shown) via a coupling belt, a coupling chain (not shown) or the like. The device indicated by the reference number "30" may also be a motor 30 to rotate or to drive the sander member 31.

The platform 20 includes an orifice 29 formed or provided therein (FIGS. 2–4), for receiving the axle 30 and/or the sander member 31, and for allowing the sander member 31 to extend upwardly or outwardly beyond the platform 20. The motor-driven sander member 31 may be used to abrade or to polish or to sand the objects, and will generate typical sand dusts. The sand dusts may be drawn or vacuumed into the chamber 24 via the apertures 25 of the platform 20, and may thus be collected in a container (not shown) or the like, to prevent the sand dusts from flying everywhere within the working environment and from polluting the lungs of the users or workers.

The platform 20 may further include a peripheral recess or peripheral shoulder 32 formed or provided therein, such as located around the orifice 29 thereof, for seating or anchoring or supporting a throat plate or supporting plate 40 therein. The throat plate or supporting plate 40 may be secured to the platform 20 with such as fasteners 33 or the like, and may include one or more holes 41 formed therein and arranged for communicating with the chamber 24 of the platform 20, for allowing the air or the sand dust to also flow into the chamber 24 via the holes 41 of the plate 40, best shown in FIG. 4.

The throat plate or supporting plate 40 may further include an opening 42 formed therein and aligned with the orifice 29 of the platform 20, and arranged for receiving the axle 30 and/or the sander member 31. It is preferable that the opening 42 of the plate 40 includes a size or area or inner diameter equals to or smaller than that of the orifice 29 of the platform 20, for suitably covering or shielding the orifice 29 of the platform 20. However, the size or area or inner diameter of the opening 42 of the plate 40 may also be selectively greater than that of the orifice 29 of the platform 20, when required.

As shown in the drawing figures, particularly in FIGS. 4–8, the sander device may include two or more throat plates or supporting plates 40 that may include different numbers of the holes 41 formed therein and that may include an opening 42 of different sizes or areas or inner diameters for adjustably supporting sander barrels or sander members 31 of different sizes or outer diameters. The platform 20 may further include one or more spacers or inserts or blocks 34 selectively secured thereto and engaged into the orifice 29 thereof, to partially fill the orifice 29 thereof, and to suitably receive the sander members 31 of different sizes or outer diameters in the orifice 29 of the platform 20. For example, the blocks 34 may include an extension 35 (FIG. 4) extended therefrom, for selectively attaching or securing to the platform 20.

In operation, as shown in FIG. 4, when the sander member 31 is rotated or driven to abrade or to polish or to sand the objects, and thus to generate sand dusts, the sand dusts may be drawn or vacuumed into the chamber 24 via the apertures 25 of the platform 20 and/or via the holes 41 of the plate 40, and may be collected in a container (not shown) or the like, to prevent the sand dusts from flying everywhere within the working environment and from polluting the lungs of the users or workers.

Accordingly, the abrading machine, polishing machine, sander machine or sander device in accordance with the present invention includes a vacuuming structure for vacuuming or drawing or collecting the sand dust that may be generated by the sander device, and including an adjustable structure for adjustably supporting two or more sander barrels of different sizes or outer diameters, and including two or more throat or supporting plates having openings of different sizes or inner diameters for adjustably supporting sander barrels of different sizes or outer diameters.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander device comprising:

a platform including an outer surface, and including a chamber formed in said platform, and including at least one aperture formed in said outer surface of said platform and communicating with said chamber of said platform, and an orifice formed in said platform, a supporting plate being secured to said platform and including an opening aligned with said orifice of said platform, and a rotatable sander member extend through said orifice of said platform, for being driven to abrade or polish or sand objects, and to generate sand dusts, said opening of said supporting plate being arranged for receiving said sander member, said at least one aperture of said platform being arranged to allow the sand dusts to be drawn or vacuumed into said chamber via said at least one aperture of said platform.

2. The sander device as claimed in claim 1, wherein said platform includes an outlet port for coupling to a vacuum device.

3. The sander device as claimed in claim 2, wherein said platform includes a bottom plate attached to bottom, and said outlet port is provided in said bottom plate.

4. The sander device as claimed in claim 1 further comprising a base, and a bracket attached to said base for rotatably supporting said sander member on said bracket.

5. The sander device as claimed in claim 4, wherein said bracket includes an axle rotatably disposed on said bracket, said sander member is secured to said axle.

6. The sander device as claimed in claim 4, wherein said platform includes a rod adjustably secured to said bracket.

7. The sander device as claimed in claim 1, wherein said supporting plate includes at least one hole communicating with said chamber of said platform and located beside said at least one aperture of said platform, for allowing the sand dust to also flow into said chamber of said platform via said at least one hole of said supporting plate.

8. The sander device as claimed in claim 1, wherein said platform includes a peripheral shoulder located around said orifice, of said platform for seating and supporting said supporting plate.

9. The sander device as claimed in claim 1, wherein at least one second plate is selectively secured to said platform when said supporting plate is disengaged from said platform and includes an opening formed in said at least one second plate, and said opening of said at least one second plate includes an area different from that of said opening of said supporting plate.

10. The sander device as claimed in claim 1, wherein a block is selectively secured to said platform and engaged into said orifice of said platform, to partially fill said orifice of said platform and for adjustably supporting a second sander member which includes an outer diameter different from that of said sander member.

* * * * *